United States Patent [19]

Medwell

[11] Patent Number: 4,656,674

[45] Date of Patent: Apr. 14, 1987

[54] COMPOSITE HELMET

[75] Inventor: Roger T. A. Medwell, Coventry, England

[73] Assignee: National Plastics Limited, Colchester, England

[21] Appl. No.: 790,740

[22] Filed: Oct. 24, 1985

[30] Foreign Application Priority Data

Oct. 31, 1984 [GB] United Kingdom ..... 8427469

[51] Int. Cl.[4] ..... A42B 3/00

[52] U.S. Cl. ..... 2/410; 2/2.5; 2/192; 2/412

[58] Field of Search ..... 2/410, 412, 425, 192, 2/200, 6, 2.5

[56] References Cited

U.S. PATENT DOCUMENTS

| | | | |
|---|---|---|---|
| 1,481,975 | 2/1924 | Bender | 2/195 X |
| 2,610,322 | 9/1952 | Daly | 2/412 |
| 2,682,668 | 7/1954 | Hoeflich | 2/200 X |
| 3,430,266 | 3/1969 | Andrian | 2/193 |
| 3,523,303 | 8/1970 | Wagenfeld | 2/200 |

FOREIGN PATENT DOCUMENTS

| | | | |
|---|---|---|---|
| 0018792 | 11/1980 | European Pat. Off. . | |
| 1460834 | 10/1966 | France | 2/410 |
| 2258136 | 8/1975 | France | 2/192 |
| 7909882 | 10/1979 | France . | |
| 2501851 | 9/1982 | France | 2/410 |
| 2135173 | 8/1984 | United Kingdom | 2/410 |

*Primary Examiner*—Peter Nerbun
*Attorney, Agent, or Firm*—Richard D. Weber

[57] ABSTRACT

This invention relates to the production of composite helmets. Such helmets are sometimes used by soldiers to provide "ballistic protection" and are then sometimes referred to as "ballistic helmets". A method is disclosed that includes cutting a length of reinforced fabric along a zig-zag line to form two distinct parts, winding a number of layers of each part on formers, the layers having teeth formations in staggered relationship, bending the teeth, and introducing synthetic resin during a molding step.

4 Claims, 6 Drawing Figures

FIG. 1
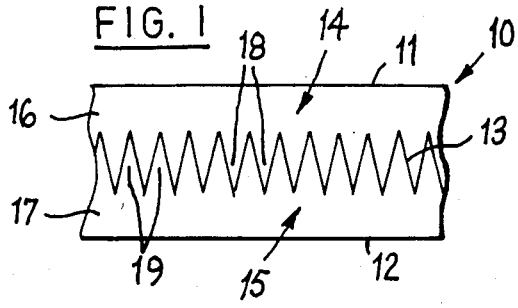
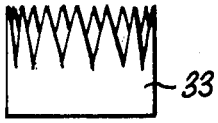
FIG. 4
FIG. 2
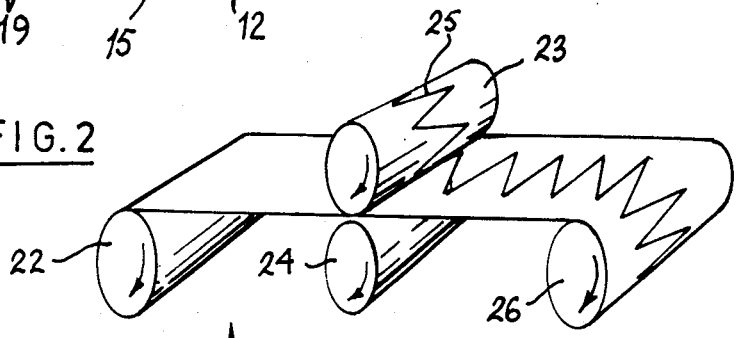
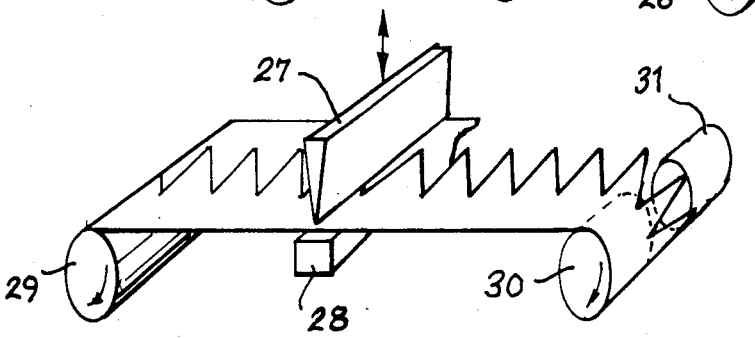
FIG. 3
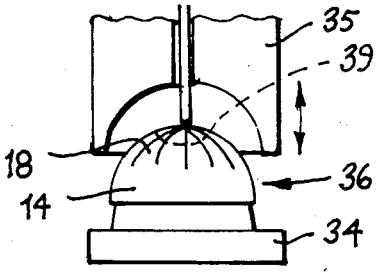
FIG. 5
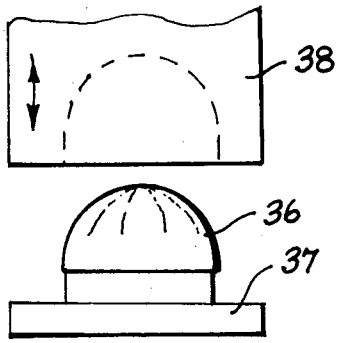
FIG. 6

COMPOSITE HELMET

DISCUSSION OF PRIOR ART

Hitherto, composite helmets have been made from strong fabric impregnated with a phenolic resin and cut into a shape called a pinwheel comprising a crown from which radiate a plurality of petals. A number of pinwheels are superposed by placing the crowns of the pinwheels on top of one another so that their petals are in staggered relationship. The preform which results is placed in a heated mold, comprising matched steel dies, in a compression press and is subjected to heat and pressure to form the helmet.

In making the pinwheels, much fabric is cut to waste and although the severed pieces of fabric can be built into subsequent preforms, the procedure is labor intensive. The present invention provides a procedure for making composite helmets involving manufacture of a preform from a blank which reduces the amount of wasted fabric.

SUMMARY OF THE INVENTION

According to one aspect of the invention, a method of making a blank for a preform for a composite helmet comprises cutting a length of reinforcing fabric along a zig-zag line so that the length of fabric is dividable along the cutting line into two parts, each part comprising an uncut longitudinally extending base portion and a series of teeth projecting from the said uncut base portion along one edge thereof.

The fabric may be impregnated with a resin before or after cutting.

The cutting may be carried out by a knife blade on a rotary cutter or by a die cutter.

The fabric may be wound after cutting onto two juxtaposed cylindrical formers having a diameter such that they are approximately the same size as the opening in the helmet to be manufactured. The pitch of the teeth in each part of the cut fabric is advantageously such that when wound on the former, teeth of successive layers of fabric are in staggered relationship.

In making a preform from the cut fabric, one part of the fabric, having been wound on a former to produce a plurality of layers of fabric with overlapping teeth, is shaped by bending the teeth inwardly towards one another so that they meet or overlap at the crown of a helmet shape. The teeth are then joined to one another in the region of the crown, for example by welding, and the preform thus produced is placed in a mold and subjected to heat and pressure to produce a helmet.

The invention includes a composite helmet made from a preform comprising a blank as described above.

The invention will be further described, by way of example, with reference to the accompanying drawing in which:

BRIEF DESCRIPTION OF THE DRAWING

FIG. 1 shows part of a blank for a preform according to the invention,

FIG. 2 is a diagram illustrating one method of cutting a blank as shown in FIG. 1, FIG. 3 illustrates the dividing of the blank of FIG. 1 into preform lengths, FIG. 4 illustrates a step in the formation of a preform according to the invention, FIG. 5 is a diagram illustrating the final operation in making a preform according to the invention, and FIG. 6 is a diagram illustrating the molding operation to make a helmet from a preform according to the invention.

DESCRIPTION OF PREFERRED EMBODIMENT

The blank for a preform according to the invention shown in FIG. 1 is a length of fabric 10 with straight parallel edges 11 and 12 and, in this case, pre-impregnated with resin. The length of fabric 10 has been cut along a zig-zag line 13 such that the length of fabric can be divided along the line 13 into two parts 14 and 15 each comprising an uncut base portion 16 or 17 adjacent the longitudinal edge 11 or 12 respectively, and a series of identical evenly space teeth 18 or 19 projecting from the uncut portion 16 or 17 away from the associated edge 11 or 12.

The length of fabric 10 may be cut by intermittent feeding through a die cutter or it may be cut in an apparatus as shown in FIG. 2 in which the fabric is unrolled from a feed roll 22 and is passed between rollers 23 and 24, the roller 23 carrying knife blades 25 suitably oriented in relation to the axis of the roller 23 to produce conterminous zig-zag cuts in the fabric. Roller 24 serves as a backing roller and the cut fabric is wound up on a roller 26.

The roll of cut fabric is next taken to an apparatus as shown in FIG. 3 where a guillotine 27 acting against a block 28 severs the fabric, unwound from a roller 29, into preform units. If necessary a bandsaw or other cutting device may be used in place of a guillotine. The two preform units resulting from each operation of the guillotine 27 are wound up on separate cylindrical formers 30, 31 juxtaposed on a common axis at the take-up end of the apparatus of FIG. 3.

The diameter of the cylindrical formers 30 is such that the cross-section of each former is approximately the same as the opening in the helmet to be manufactured. The pitch of the teeth 18 and 19 is such that when wound on the formers 30, teeth of successive layers of the fabric parts 14 and 15 are in staggered relationship. That is the teeth of the second layer of fabric overlap the gaps between the teeth of the first layer of fabric and so on, the number of layers of fabric used depending on the type of helmet to be produced. Twelve to twenty four layers are commonly used.

The rolled up layers of fabric ready for the final operation in manufacture of the preform are illustrated at 33 in FIG. 4 and FIG. 5 shows this final operation. The rolled up layers of fabric 33 of the fabric part 14 are placed on a tapering circular section support 34 and a dome-shaped die 35 descends on the ends of the teeth 18, bends them inwardly towards one another and welds them together in the crown region using a radio frequency welding technique to form a preform 36.

A small crown 39, or several such crowns, which may be circular in shape, may be located on top of or beneath the dome formed by the closing teeth or can be interleaved with them and may be welded to them in the same procedure. Other reinforcement may be provided in the same region of the dome as an alternative to or in addition to one or more crowns, for example one or more annular shaped reinforcements may be used.

Finally, to manufacture a composite helmet from the preform 36, the preform is placed on the dome-shaped male part 37 of a mold and is subjected to heat and pressure after the female part 38 of the mold has been closed down over the male part 37.

The helmet shape thus produced requires trimming and attachment of fittings for example internal padding.

The reinforcing fabric 10 used for the blanks and for the crown reinforcement 39 may be a woven fabric made of polyaramid fibre or a ballistic quality nylon fibre.

The resin used for impregnation of the reinforcing fabric could be a phenolic resin (e.g. a 50:50 solids blend of phenol-formaldehyde and polyvinylbutyral resins), a polyester resin or a themoplastic resin.

What is claimed is:

1. A method of making a composite protective helmet reinforced with fabric, said method including the steps of:

cutting a length of reinforced fabric along a zig-zag line so that the length of the fabric is dividable along the cutting line into two parts, each part comprising an uncut longitudinally extending base portion and a series of teeth projecting from said uncut base portion along one edge thereof;

winding a number of layers of one of said cut parts of the reinforcing fabric on a former having a diameter approximately the same size as the opening in a helmet to be manufactured, the pitch of the teeth in said fabric part being such that teeth of successive layers in the winding are in staggered relationship so that the teeth of one layer overlap gaps between teeth of the next lower layer;

bending the teeth inwardly and securing them to form a dome shape constituting a helmet pre-form;

molding said pre-form with synthetic resin to produce a helmet; and similarly using said other cut fabric part thereby reducing the amount of wasted fabric.

2. A method according to claim 1, wherein the number of layers of said cut part wound on a former is from twelve to twenty four.

3. A method according to claim 1, wherein the teeth are bent inwardly so that teeth of the same layer meet and the inwardly bent teeth are secured to one another.

4. A method according to claim 1, wherein the dome shape is further reinforced by introduction of at least one further piece of reinforcing fabric in the region of the crown.

* * * * *